US008453631B1

(12) United States Patent
Kronengold et al.

(10) Patent No.: US 8,453,631 B1
(45) Date of Patent: Jun. 4, 2013

(54) RELEASE ASSEMBLY FOR CROSSBOW

(75) Inventors: David H. Kronengold, Tucson, AZ (US); Allen C. Rasor, Marana, AZ (US); Kevin Hansen, Jefferson City, MT (US)

(73) Assignee: Precision Shooting Equipment, Inc, Tucson, AZ (US)

( * ) Notice: Subject to any disclaimer, the term of this patent is extended or adjusted under 35 U.S.C. 154(b) by 0 days.

(21) Appl. No.: 13/558,173

(22) Filed: Jul. 25, 2012

Related U.S. Application Data

(62) Division of application No. 12/350,123, filed on Jan. 7, 2009, now Pat. No. 8,240,299.

(51) Int. Cl.
*F41B 5/12* (2006.01)
*F41B 5/18* (2006.01)
*F41B 5/14* (2006.01)

(52) U.S. Cl.
CPC ..... *F41B 5/12* (2013.01); *F41B 5/1469* (2013.01)
USPC ..... 124/25; 124/31; 124/35.1; 124/35.2; 124/40; 124/86; 124/88; 124/90

(58) Field of Classification Search
CPC ..... F41B 5/12; F41B 5/1469
USPC ..... 124/25, 31, 35.1, 35.2, 40, 86, 88, 124/90
See application file for complete search history.

(56) References Cited

U.S. PATENT DOCUMENTS 3,483,857 A 12/1969 Jones
3,581,729 A 6/1971 Jones
3,922,795 A 12/1975 Bettencourt
4,030,473 A 6/1977 Puryear
4,603,676 A * 8/1986 Luoma ..... 124/25
4,716,880 A 1/1988 Adkins
5,085,200 A * 2/1992 Horton-Corcoran et al. ... 124/25
5,115,795 A * 5/1992 Farris ..... 124/86
5,215,069 A * 6/1993 Liu ..... 124/25
5,243,956 A * 9/1993 Luehring ..... 124/86
5,598,829 A * 2/1997 Bednar ..... 124/25
5,680,724 A * 10/1997 Peterken ..... 42/70.11
5,823,172 A * 10/1998 Suggitt ..... 124/25
6,095,128 A * 8/2000 Bednar ..... 124/25
6,286,496 B1 * 9/2001 Bednar ..... 124/25
6,425,386 B1 * 7/2002 Adkins ..... 124/31

(Continued)

OTHER PUBLICATIONS

2007 Owner's Manual, "Stryker", Stryker Manufacturing, 10 pages, Eugene, Oregon, (published in 2007).

*Primary Examiner* — Gene Kim
*Assistant Examiner* — Alexander Niconovich
(74) *Attorney, Agent, or Firm* — Cahill Glazer PLC

(57) ABSTRACT

A crossbow includes an elongated frame coupled to a riser at a first end thereof. The riser supports a pair of flexible limbs, and a bowstring extends between such limbs. A movable bowstring release is used both to retract the bowstring into a drawn position, and to release the bowstring under the operation of a trigger assembly. The bowstring release is initially positioned near the bowstring at rest, and a bowstring hook is engaged therewith. A bowstring retractor includes a retractor rope secured to the bowstring release for retracting the bowstring. An upper housing is secured to the second end of the elongated frame, and supports a rope spool used to wind the retractor rope. The bowstring release is retracted into the upper housing proximate a trigger assembly for selectively releasing the bowstring when a user pulls a trigger.

20 Claims, 11 Drawing Sheets

U.S. PATENT DOCUMENTS

| | | | | |
|---|---|---|---|---|
| 6,705,304 | B1 * | 3/2004 | Pauluhn | 124/25 |
| 6,722,072 | B1 * | 4/2004 | McCormick | 42/75.03 |
| 6,736,123 | B1 * | 5/2004 | Summers et al. | 124/25 |
| 6,802,304 | B1 * | 10/2004 | Chang | 124/25 |
| 6,874,491 | B2 * | 4/2005 | Bednar | 124/25 |
| 6,913,007 | B2 * | 7/2005 | Bednar | 124/25 |
| 6,925,744 | B2 | 8/2005 | Kincel | |
| 7,100,590 | B2 * | 9/2006 | Chang | 124/25 |
| 7,168,424 | B1 * | 1/2007 | Wing | 124/20.1 |
| 7,174,884 | B2 * | 2/2007 | Kempf et al. | 124/25 |
| 7,363,740 | B2 | 4/2008 | Kincel | |
| 7,588,022 | B2 * | 9/2009 | Chang | 124/25 |
| 7,624,725 | B1 * | 12/2009 | Choma | 124/25 |
| 7,810,480 | B2 * | 10/2010 | Shepley et al. | 124/25 |
| 7,814,894 | B2 * | 10/2010 | Giroux | 124/25 |
| 7,891,348 | B2 * | 2/2011 | Colley | 124/25 |
| 7,997,258 | B2 * | 8/2011 | Shepley et al. | 124/25 |
| 8,091,540 | B2 * | 1/2012 | Matasic et al. | 124/31 |
| 2009/0078243 | A1 * | 3/2009 | Bednar et al. | 124/31 |
| 2009/0277435 | A1 * | 11/2009 | Pestrue | 124/25 |
| 2010/0170488 | A1 * | 7/2010 | Rasor et al. | 124/25 |

* cited by examiner

RELEASE ASSEMBLY FOR CROSSBOW

CROSS-REFERENCE TO RELATED APPLICATIONS

This application is a divisional of U.S. patent application Ser. No. 12/350,123, filed on Jan. 7, 2009, for "Release Assembly for Crossbow", assigned to the assignee of the present application, and subsequently issued as U.S. Pat. No. 8,240,299, and the benefit of the earlier Jan. 7, 2009 filing date of such parent patent application is claimed hereby.

The present application is also related to a co-pending application Ser. No. 12/350,131, filed Jan. 7, 2009, and entitled "Compact Winding Mechanism for Crossbow", assigned to the assignee of the present application.

The present application is also related to application Ser. No. 12/350,106, filed Jan. 7, 2009, entitled "Crossbow Accessory for Lower Receiver of Rifle and Related Method", assigned to the assignee of the present application, issued as U.S. Pat. No. 7,810,480 on Oct. 12, 2010.

BACKGROUND OF THE INVENTION

1. Field of the Invention

The present invention relates generally to crossbows, and more specifically, to a mechanism for releasing the bowstring of a crossbow to fire an arrow.

2. Description of the Related Art

Crossbows have also long been known in the archery field for use in hunting game. Crossbows have higher draw weights than conventional archery bows and fire arrows (or "bolts") with greater speeds. As a result, crossbows usually have greater range than an archery bow.

When crossbows are configured for firing, the force exerted by the retracted bowstring can be in the range of approximately 100 to 200 pounds. The trigger assembly of the crossbow must be capable of holding the bowstring in firing position, while allowing the bowstring to be released as the user pulls the trigger. This often results in an excessive pull force which the user must exert upon the trigger of the crossbow to fire the arrow, which in turn decreases the accuracy of the shot.

Crossbows can be relatively heavy, making them more difficult to carry and operate quickly. Complex trigger mechanisms and bowstring retraction systems often contribute to such excessive weight.

U.S. Pat. No. 6,095,128, to Bednar, shows and describes a crossbow that includes an integrated bowstring draw mechanism. The bowstring is drawn back along the barrel, or stock, of the crossbow by a drawing mechanism integrated into the tailstock of the crossbow. The drawing mechanism is operated by a hand crank inserted into the tailstock of the crossbow. A claw is engaged over the bowstring, and the claw is retracted rearward by a pair of cables to pull the bowstring into a trigger mechanism that selectively holds and releases the bowstring. The cables attached to the claw extend back to the drawing mechanism housed in the tailstock of the crossbow. Once the bowstring is pulled back into engagement with the trigger mechanism, the drawing mechanism is released, and the claw is removed from the bowstring. An arrow is inserted into the crossbow, nocked with the bowstring, and rests upon the upper surface of the barrel in preparation for firing. The upper surface of the barrel includes a central channel or arrow guide, and the arrow slides along the arrow guide when the arrow is fired. This is often referred to as the "rail" of the barrel. This need to remove the claw from the bowstring after engaging the bowstring with the trigger mechanism requires additional time between shots of the crossbow.

U.S. Pat. No. 5,598,829, to Bednar, shows and describes a trigger mechanism designed for use in a crossbow. The bowstring is drawn back by a drawing mechanism and engaged with a string release latch. The string release latch is normally biased toward a release position by a spring. The string release latch is releasably coupled, via sear surfaces and a rocker latch, to the crossbow trigger. Rearward force of the bowstring against the string release latch causes the string release latch to pivot toward its cocked position and resets the trigger. The drawing mechanism is then removed from the bowstring, and the bowstring is retained by the string release latch until the trigger is pulled.

As demonstrated by the above-referenced patents to Bednar, the customary practice in the field of crossbows is to secure a bowstring release latch at a fixed point near the rear of the crossbow, adjacent the trigger of the crossbow, and to draw the bowstring back into engagement with the fixed-position bowstring release latch. The drawing mechanism must then be removed from the bowstring, and perhaps stored, before the crossbow can be fired. Moreover, the bowstring release latch must be in physical contact, via one or more sear surfaces, with the trigger to retain the bowstring in firing position. Again, this requirement often results in the need for the user to exert excessive finger pull pressure on the trigger to release the bowstring, particularly when the crossbow has a relatively high draw weight.

Other methods for drawing and firing the bowstring of a crossbow have also been proposed. For example, in U.S. Pat. No. 4,603,676, to Luoma, a crossbow is described wherein the trigger is incorporated within a movable housing that resembles the handle of a caulking gun. The movable housing includes a cocking handle that can be reciprocated to move the housing (including the trigger) rearward along a drawback rod that extends rearward from the riser of the crossbow. The housing is initially moved forward along the drawback rod to engage the bowstring with the trigger mechanism. The cocking handle is then squeezed and released a number of times to move the housing, trigger, and bowstring, rearward along the drawback rod in stepwise increments until reaching the fully drawn position, at which time, an arrow may be loaded and fired. The cocking mechanism disclosed by Luoma does not permit rapid retraction of the bowstring, and the drawback rod does not appear to be sufficiently sound to bear significant draw weights while ensuring an accurate shot.

Stryker Manufacturing of Eugene, Oreg. has offered a crossbow under the brand name "Stryker" wherein a bowstring hook is secured to a chain for sliding motion along the barrel and rail of the crossbow. The chain is disposed below the rail, and a winding crank is used to move the chain forward and rearward. To draw the bowstring back, the crank is operated to move the chain and attached string carrier forward until the string carrier reaches the bowstring. The Stryker owner's manual states that the user should crank the crossbow approximately 40 evolutions, while depressing a thumb pawl, before the string carrier reaches its forward-most position adjacent the bowstring. The user then manually closes the string hook over the bowstring. The thumb pawl is then released, and the crank is rotated in the opposite direction to draw the string carrier and bowstring rearward until reaching a fully-drawn position. An arrow is then loaded onto the rail and slid under a hold down spring to be nocked with the bowstring. In the fully-cocked position, the string carrier is disposed proximate to the crossbow trigger, and the operation of the trigger causes the string carrier to release the bowstring and fire the arrow. After firing, the above-described procedure must be repeated to fire another arrow. The chain drive retraction system used by the Stryker-brand bow results in extended times for firing a second arrow after a first arrow is fired, primarily because the crank must be operated in order to move the string carrier forward to engage the bowstring. In addition, the requirement for loading the arrow upon a rail, and the resulting frictional forces between the arrow and the rail during firing, limit the arrow speed that can be produced by such a crossbow.

Accordingly, it is an object of the present invention to provide a crossbow which releases the bowstring in an accurate, consistent, and repeatable manner.

Another object of the present invention is to provide such a crossbow which avoids the need for a user to exert excessive trigger pull force to release the bowstring, and wherein the trigger pull force can be made independent of the draw weight of the bowstring.

Still another object of the present invention is to provide such a crossbow having a bowstring release and bowstring draw mechanism that are relatively light in weight, compact, easy to operate, relatively inexpensive, and compatible with anti-dry fire safeguards.

A further object of the present invention is to provide such a crossbow which avoids the need to remove and store a bowstring draw mechanism before firing an arrow.

A yet further object of the present invention is to provide such a crossbow that avoids the necessity for the arrow to slide along a top rail, and thereby avoids frictional forces that otherwise result between the arrow and the top rail.

Yet another object of the present invention is to provide such a crossbow that allows a user to quickly engage the bowstring with a draw mechanism in preparation for pull-back to the drawn position, and to quickly retract the bowstring to the fully-drawn position, thereby reducing the time between firing a first arrow and firing a second arrow.

These and other objects of the present invention will become more apparent to those skilled in the art as the description thereof proceeds.

SUMMARY OF THE INVENTION

Briefly described, and in accordance with a preferred embodiment thereof, the present invention relates to a crossbow which includes certain components that are conventionally included in a crossbow, including a rigid riser (or "prod"), and first and second flexible limbs coupled to opposing end portions of the riser. A bowstring extends between the limb tips of the first and second limbs for propelling an arrow, or "bolt". Preferably, first and second pulleys/cams are rotatably supported at the limb tips of the first and second limbs, respectively, and the bowstring extends between such first and second pulleys. Preferably, the crossbow further includes power cables engaged with the first and second pulleys/cams to enhance the force/draw characteristics of the crossbow.

The crossbow further includes an elongated frame member, generally corresponding to the "stock" or "barrel" of a conventional crossbow. A first end of the elongated frame is coupled to the central portion of the riser. A trigger is disposed proximate the second end of the elongated frame for being pulled by a user.

A bowstring release includes a bowstring hook for selectively engaging the bowstring. The bowstring release also includes an actuating lever responsive to the trigger for selectively releasing the bowstring from the bowstring hook when a user pulls the trigger. In the preferred embodiment, the actuating lever is struck by a spring-biased hammer released by the trigger.

A bowstring retractor is coupled to the second end of the elongated frame. The bowstring retractor includes a retractable rope coupled to the bowstring release for pulling the bowstring release, and the bowstring engaged therewith, away from the riser toward a drawn position proximate the second end of the elongated frame member. When fully-drawn, the bowstring release is positioned to dispose its actuating lever proximate to the trigger assembly. In the preferred embodiment, the trigger releases a spring-biased hammer which strikes such actuating lever to release the bowstring.

The bowstring retractor preferably includes an upper housing coupled to the second end of the elongated frame. A spool is rotatably supported within the upper housing for winding the retractor rope. A crank arm is provided to rotate the spool, and to wind the rope around the spool, to pull the bowstring release, and the bowstring engaged therewith, toward the drawn position. The crank arm can directly drive the spool, but it is preferred that the spool be provided with at least one spool gear, and that the crank arm first turns a reducing gear, or spur gear, meshed with a spool gear, to reduce the amount of force that needs to be applied by the user. The spur gear is supported upon a drive axle coupled with the spur gear, and the crank arm is preferably used to rotate the drive axle; operation of the winding crank rotates the drive axle and spur gear, which rotates the spool to wind the retractor rope. Ideally, the spool includes a second gear which is selectively engaged by a pawl for permitting rotation of the spool in a first direction, and for selectively preventing rotation of the spool in a second, opposing direction. The retractor rope has a first end secured to the spool and a second end coupled to the bowstring release. Preferably, the spool has a hole formed transversely therethrough for receiving the first end of the retractor rope. The bowstring retractor also preferably includes a pawl release for disengaging the pawl from the spool gear to permit the bowstring release and second end of the rope to be pulled from the upper housing toward the bowstring to engage the bowstring hook with the bowstring.

As noted above, the components of the bowstring retractor (with the exception of thecrank arm) are contained within the aforementioned upper housing located proximate the second end of the elongated frame. The same upper housing also preferably serves to aid in positioning the bowstring release into its proper fully-drawn position. As the bowstring release approaches its fully-drawn position, it is pulled into the upper housing proximate the trigger, wherein the actuating lever of the bowstring release is disposed proximate to the trigger. In the preferred embodiment, the upper surface of the elongated frame has a guide channel formed therein; this guide channel extends from at least the rest position of the bowstring to the upper housing. The guide channel receives the base of the bowstring release, and assists in guiding the bowstring release along the elongated frame, and into the upper housing, as the bowstring release is retracted.

In the preferred embodiment, the bowstring release includes a cocking bar for cocking the trigger assembly as the bowstring release is retracted into the upper housing. Assuming, for example, that the trigger assembly includes a spring-biased hammer, then the cocking bar can automatically reset the hammer into a cocked position as the bowstring release is retracted into the upper housing. Ideally, the cocking bar is pivotally mounted to the bowstring release; the cocking bar is prevented from pivoting when the bowstring is being retracted. After an arrow is fired, the cocking bar is permitted to pivot to avoid any interference with the trigger assembly, or the hammer thereof, when the bowstring release is pulled away from the upper housing. Preferably, the end of the retractor rope that is coupled to the bowstring release is engaged with the cocking bar to prevent the cocking bar from pivoting when the rope is taut, while permitting the cocking bar to pivot when the rope is slack.

Another aspect of the present invention relates to a method of operating such a crossbow. In practicing such method, a bowstring release is provided, the bowstring release including a bowstring hook for selectively engaging the bowstring, and an actuating lever for releasing the bowstring hook. A retractor rope is attached to the bowstring release. Initially, the bowstring release is moved toward the bowstring, and the bowstring hook is engaged with the bowstring. The rope is then pulled to retract the bowstring release, and the bowstring engaged thereby, toward the second end of the elongated frame until the bowstring is in a drawn position, wherein the bowstring release is positioned proximate the second end of the elongated frame, and the actuating lever of the bowstring release is disposed proximate to the trigger assembly of the crossbow. The user then operates the trigger to release the bowstring, and to propel an arrow.

In practicing such method, the retractor rope is preferably pulled by rotatably supporting a rope spool proximate the second end of the elongated frame, engaging one end of the rope with the rope spool, and rotating the spool to wind the rope around the spool, thereby pulling the bowstring release, and the bowstring engaged thereby, toward the drawn position. Preferably, such method includes coupling at least one spool gear to the spool, and engaging a pawl with the spool gear for permitting rotation of the spool in a first direction, and for selectively preventing rotation of the spool in a second, opposing direction.

The aforementioned method also preferably includes forming a rope attachment hole extending transversely through the rope spool, and passing an end of the rope through the rope attachment hole for securing an end of the rope to the rope spool.

In the preferred form of practicing the aforementioned method, the step of rotating the rope spool includes the steps of coupling a spool gear to the spool, engaging the spur gear with the spool gear, and cranking the spur gear to rotate the spool, and to wind the rope about the spool, to pull the bowstring release, and the bowstring engaged thereby, into the drawn position.

Preferably, the present method includes the step of providing an upper housing upon the ear end of the elongated frame for housing the bowstring retractor components. In the preferred embodiment, the bowstring release is retracted into a throat of the upper housing for guiding the bowstring release into its final fully-drawn position. In this regard, the upper surface of the elongated frame may advantageously include a channel extending between the rest position of the bowstring and the throat of the upper housing. In practicing the present method, the bowstring release is preferably guided by the channel as it is retracted back into the throat of the upper housing.

The method of the present invention also preferably includes the steps of securing a cocking bar to the bowstring release, and cocking the trigger assembly of the crossbow by engaging the cocking bar with the trigger assembly as the bowstring release is pulled back into its drawn position. Ideally, this is done by engaging a spring-biased hammer of the trigger assembly. In order to avoid interference with the removal of the bowstring release from the upper housing, the present method preferably includes the step of pivotally securing the cocking bar to the bowstring release, and preventing pivotal movement of the cocking bar when the bowstring release is being pulled into its drawn position. On the other hand, the present method preferably includes the step of allowing the cocking bar to pivot around the trigger assembly (e.g., around the hammer) after the crossbow is fired. The preferred method for doing so is to secure an end of the retractor rope to the cocking bar for essentially locking the cocking bar in a cocking position when the rope is under tension. After firing the crossbow, the user releases tension from the retractor rope in preparation for removal of the bowstring release from the upper housing, and the cocking bar is then permitted to freely pivot around trigger assembly components.

DETAILED DESCRIPTION OF THE PREFERRED EMBODIMENTS

Figure 1:
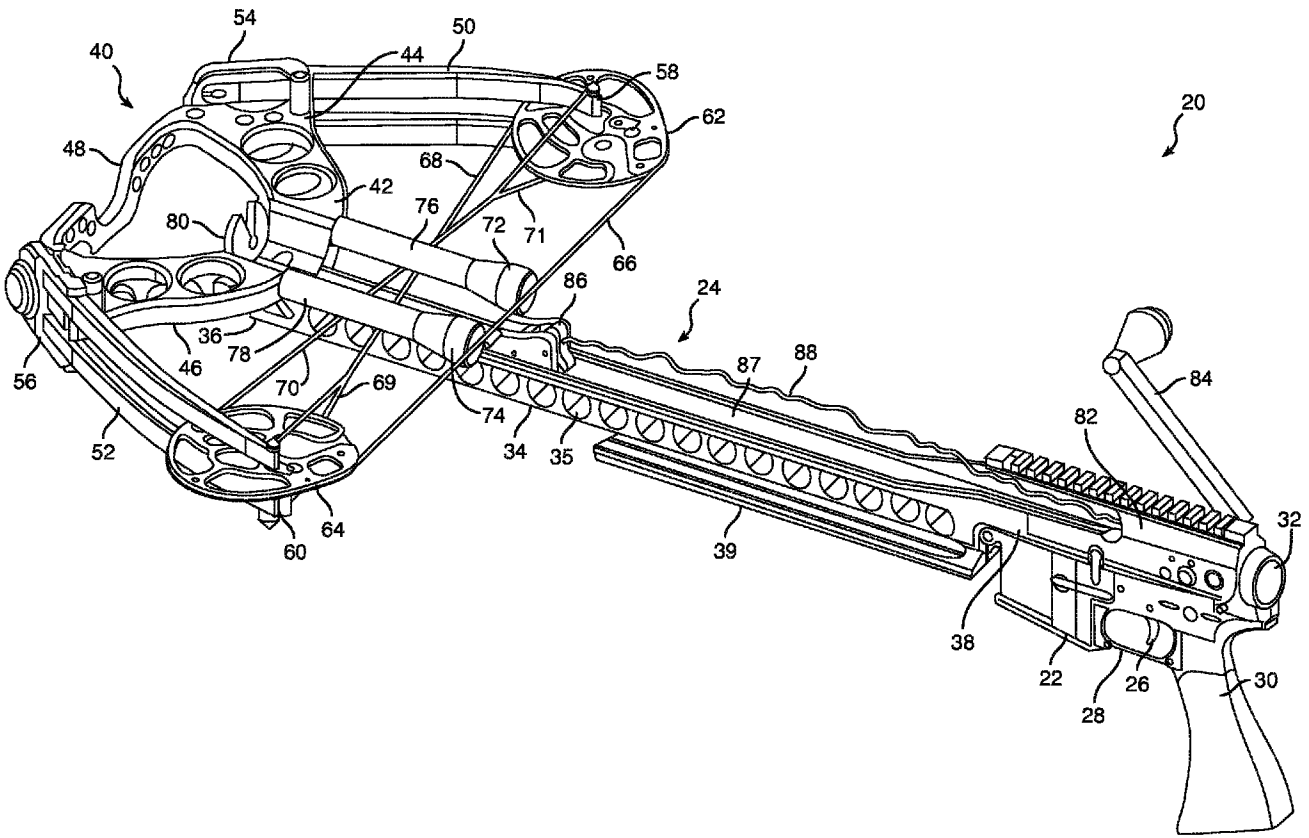
FIG. 1 is a perspective view of a crossbow accessory in accordance with a preferred embodiment of the present invention.

FIG. 1 shows a crossbow, designated generally by reference numeral 20, and including the modular lower receiver 22 of an AR-15 style rifle attached to crossbow accessory 24. While the described embodiment uses an AR-15 style lower receiver 22, those skilled in the art will appreciate that the present invention can also be practiced by using lower receivers of other models of rifles. In addition, while the described embodiment of the present invention is a crossbow accessory for an existing lower receiver already owned by a user, those skilled in the art will appreciate that a manufacturer could, if desired, incorporate a trigger and hammer assembly into the described crossbow accessory 24 to provide an integral crossbow while practicing the inventive features described and claimed herein.

As is known to gun enthusiasts, lower receiver 22 includes a finger trigger 26 which extends downwardly from the housing of lower receiver 22. A trigger guard 28 may also be included. A pistol grip 30 is also preferably provided along with lower receiver 22. The rear end of lower receiver 22 includes a threaded opening 32 adapted to receive a removable buttstock. For example, a buttstock of the type shown and described in U.S. Pat. No. 7,363,740 to Kincel, may be threadedly engaged with the threaded opening 32 of lower receiver 22. The addition of such a buttstock allows for positioning crossbow 20 against the user's shoulder for increased accuracy.

While not illustrated in FIG. 1, lower receiver 22 also houses a spring-biased hammer that may be cocked into a firing position and subsequently released by pulling trigger 26. The structure and operation of the trigger, hammer, and a related "disconnector" used in a conventional AR-15 style lower receiver are described and illustrated within U.S. Pat. No. 5,680,724 (Peterken) and U.S. Pat. No. 6,722,072 (McCormick), the disclosures of which are hereby incorporated by reference. The hammer is ordinarily used to strike a firing pin on an ammunition casing to fire a bullet.

Turning to crossbow accessory 24, an elongated frame member 34, preferably made of aluminum, extends between a first end 36 and a second opposing end 38. Frame member 34 generally corresponds to the stock, barrel, or main rail, of a conventional crossbow. Openings, such as circular opening 35, may be machined along frame member 34 to lessen the weight thereof. If desired, a grooved accessory mounting rail 39, sometimes called a "Picatinny" rail", may be provided along the bottom of frame member 34 for mounting hand grips or other modular accessories often sold for use with AR-15 style rifles.

The first, or forward-most, end 36 of frame member 34 is secured to a riser 40. Riser 40 includes a central portion 42 and opposing end portions 44 and 46. A conventional foot stirrup portion 48 may also be formed integrally with riser 40, if desired. Riser 40 is preferably formed of machined aluminum. First and second flexible limbs 50 and 52 extend from end portions 44 and 46, respectively, of riser 40. As illustrated, limbs 50 and 52 are each preferably formed as "split limbs". Preferably, split limbs 50 and 52 are secured to riser end portions 44 and 46 by pivoting pocket members 54 and 56, respectively. Split limbs 50 and 52 are preferably formed of fiberglass. Limb 50 has a limb tip 58, and limb 52 has a limb tip 60.

In the preferred embodiment, first and second pulleys, preferably in the form of power cams, 62 and 64 are rotatably mounted at limb tips 58 and 60, respectively. As used herein, the term "pulley" is intended to include both circular pulleys and non-circular cams. Pulleys 62 and 64 are preferably formed of machined aluminum. It is possible to form a crossbow, in accordance with the present invention, without the use of cams or pulleys, corresponding to a conventional recurve archery bow wherein the bowstring extends directly from one limb tip to the opposing limb tip. However, the use of cams/pulleys 62 and 64 is preferred for improved performance. As used herein, a description of the bowstring 66 extending between the limb tips of the first and second limbs 50 and 52 should be understood to be inclusive of both simple recurve-style bows (without any cams or pulleys) and compound-style bows (having cams or pulleys rotatably supported at the limb tips).

A bowstring 66 extends between pulleys 62 and 64 for propelling an arrow, or "bolt". In addition, a pair of power cables, or tension cables, 68 and 70 also engage pulleys 62 and 64 to maximize the efficiency of the force applied to the arrow by bowstring 66 as an arrow is fired. Power cable 68 extends from a groove on pulley 62 to a split cable harness 69 secured to the pivot axle of opposing pulley 64. Likewise, power cable 70 extends from a groove on pulley 64 to a split harness 71 secured to the pivot axle of opposing pulley 62. As bowstring 66 is retracted toward second end 38 of frame member 34, additional portions of bowstring 66 play off of pulleys 62 and 64, while pulleys 62 and 64 wind additional portions of power cables 68 and 70. When bowstring 66 is released from a drawn position, pulleys 62 and 64 wind additional portions of bowstring 66, while power cables 68 and 70 unwind from pulleys 62 and 64. Bowstring 66, and power cables 68 and 70, are preferably made from a blend of braided Dyneema/Vectran high-molecular weight cord. The braided string and cables each preferably include 16 strands of such cord braided together. Bowstring 66 preferably has a "D-loop" 67 (see FIG. 18A) attached thereto at the nocking point, i.e., at the point where the arrow nock is engaged with bowstring 66. This D-loop 67 is engaged by a bowstring hook 162 of a bowstring release 86 in a manner described in greater detail below.

Still referring to FIG. 1, a pair of rubber stoppers 72 and 74 are positioned adjacent bowstring 66 (when bowstring 66 is at rest). Rubber stoppers 72 and 74 are supported by cylindrical rods 76 and 78, respectively, which are, in turn, attached to riser 40. Ideally, power take up cables 68 and 70 extend below and around rods 76 and 78. In this manner, rods 76 and 78 function as cable guides to deflect cables 68 and 70 away from the path of an arrow being fired. Rubber stoppers 72 and 74 serve to dampen the force of the bowstring after an arrow is fired from the crossbow.

In the preferred embodiment, the crossbow provided herein is of a "rail-less" type, meaning that the arrow being fired by the crossbow does not slide along a rail as it is being released from the crossbow. By making the crossbow rail-less, frictional drag on the arrow is reduced. The only support for the arrow being fired is provided at the rear of the arrow, where the nock of the arrow is engaged by bowstring 66, and by an arrow rest 80 secured to riser 40. The upper surface of frame member 34 preferably includes a channel 87, but channel 87 is not used to support the arrow as the arrow is being fired. In an alternate embodiment, one could, if desired, operate a crossbow of the present invention using a "rail" with minor modifications. However, "rail-less" operation is preferred.

Also depicted within FIG. 1 is an upper housing 82, a removable crank arm 84, a bowstring release 86 and a retractor rope 88. Bowstring release 86 is guided by channel 87 formed upon the upper surface of frame member 34. Additional details regarding upper housing 82, crank arm 84, bowstring release 86, and retractor rope 88, are provided herein. Retractor rope 88 is preferably made from a braided Dyneema ("Spectra") high-molecular weight cord having a diameter of 7⁄64 inch and rated at 1,400 pounds of tensile pull breaking strength. This allows the rope spool to be kept compact and yet is strong enough to avoid breakage under the 170 pound force exerted by the bowstring.

Figure 2A:
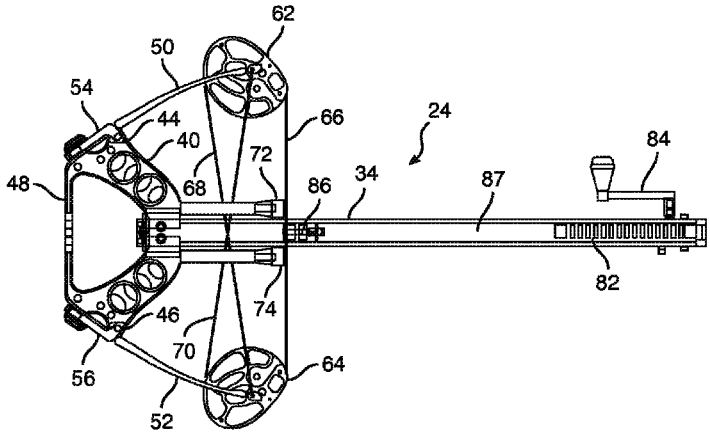
FIG. 2A is a top view of the crossbow accessory shown in FIG. 1 with the bowstring in its rest position, and with a crank arm attached to the bowstring retraction mechanism.
Figure 2B:
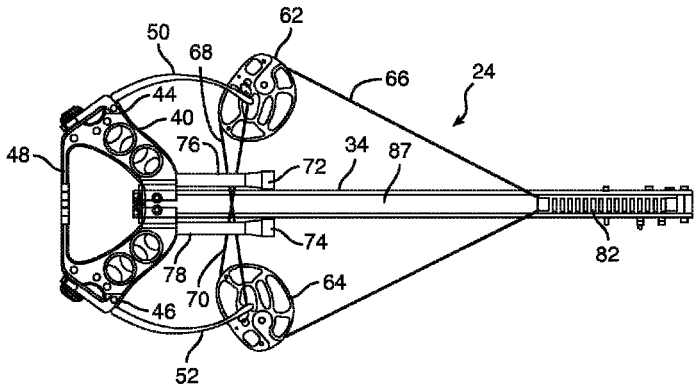
FIG. 2B is a top view of the crossbow accessory shown in FIG. 1 with the bow in its fully-drawn position, and with the crank arm removed from the bowstring retraction mechanism.

FIGS. 2A and 2B are top views of the crossbow accessory 24 shown in FIG. 1. In FIG. 2A, crossbow accessory 24 is shown with the bowstring in its rest position (at "brace height"), and with crank arm 84 attached to the bowstring retraction mechanism for retracting bowstring release 86 and bowstring 66. In FIG. 2B, crossbow accessory 24 is shown in its fully-drawn position, wherein bowstring release 86 is hidden within upper housing 82, and with crank arm 84 having been removed from the bowstring retraction mechanism.

Figure 3:
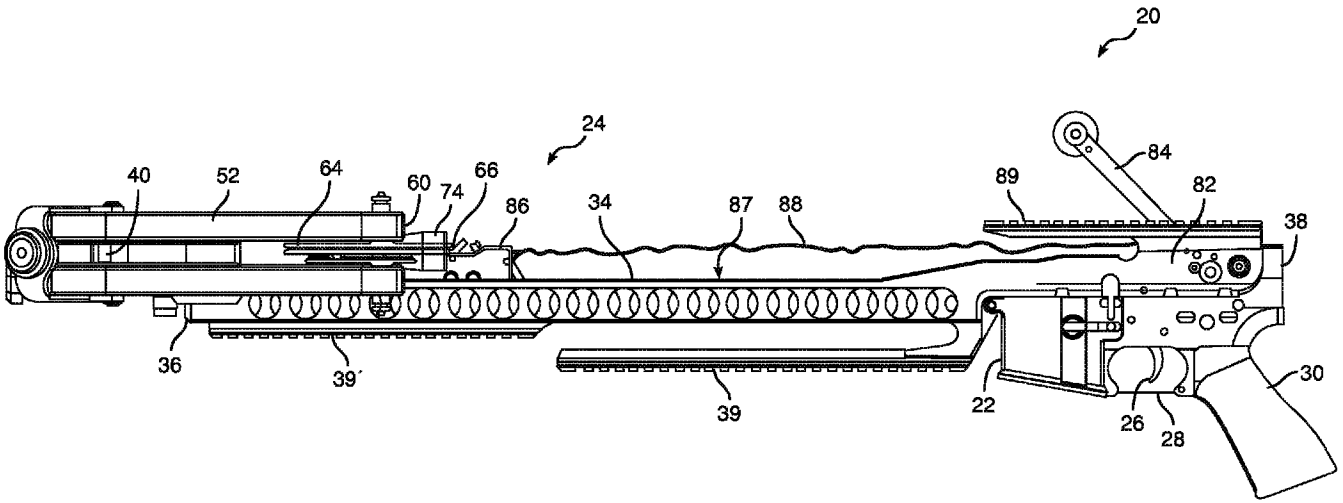
FIG. 3 is a side view of the crossbow accessory shown in FIGS. 1 and 2A with the bow in its rest position, and with a crank arm attached to the bowstring retraction mechanism.

The side view shown in FIG. 3 of crossbow 20, lower receiver 22 and crossbow accessory 24 shows many of the same components already described in regard to FIG. 1. Retractor rope 88 has been pulled out of upper housing 82 by a sufficient length to permit bowstring release to move forwardly along channel 87 to engage bowstring 66. Grooved accessory mounting rail 39 extends along and below a central portion of frame member 34; optionally, a further grooved accessory mounting rail 39' may extend along the bottom of the frontmost portion of frame member 34. Similarly, a grooved accessory mounting rail 89 may be provided along the top surface of upper housing 84 to facilitate the mounting of a telescopic sight, laser pointers, other optics, etc.

Figure 4:
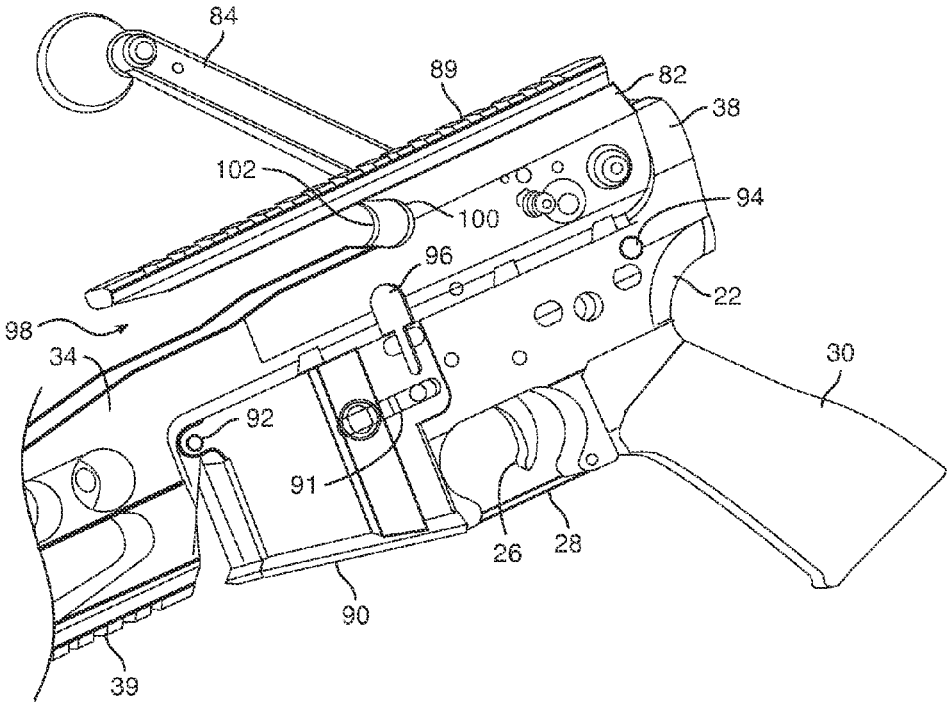
FIG. 4 is an enlarged partial perspective view of an AR-15 lower receiver attached to the second end of the elongated frame member of the crossbow accessory, and illustrating an upper housing of the crossbow accessory.
Figure 5:
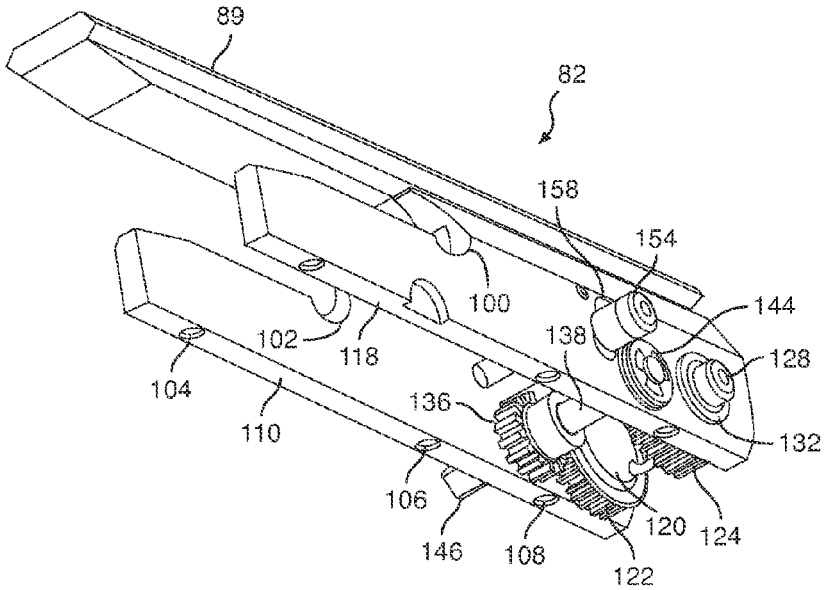
FIG. 5 is a perspective view of the upper housing, viewed from below, and prior to attachment to the second end of the elongated frame member of the crossbow accessory.

Referring to FIG. 4, lower receiver 22 include a magazine port 90 which ordinarily receives an ammunition magazine, but which is not used when crossbow accessory 24 is attached to lower receiver 22. Likewise, the "magazine catch" 91 is also left unused when crossbow accessory 24 is being used. Similarly, "bolt catch" 96 is not needed when crossbow accessory 24 is in use.

Lower receiver 22 is attached to the rear end of frame member 38 by two pins. The forward-most pin 92 is typically referred to as the "receiver pivot pin", and extends through mating holes in lower receiver 22 and second end 38 of frame member 34. The receiver pivot pin is engaged from the opposite side by a receiver pivot pin screw to prevent the receiver pivot pin from falling out unintentionally. The rearmost pin 94 is typically referred to as the "take down pin". The take down pin again extends through mating holes in lower receiver 22 and second end 38 of frame member 34. A spring-biased detent pin (not shown) engages the take down pin laterally along its shaft to prevent the take down pin from being removed unintentionally. These same two pins are conventionally used to attach lower receiver 22 to other AR-15 style modular rifle components.

Still referring to FIG. 4, it will be noted that upper housing 82 includes a throat 98 adapted to receive bowstring release 86. Throat 98 terminates in a pair of generally circular cut-outs 100 and 102 formed in the opposing sidewalls of upper housing 82. As will be explained in greater detail below, alignment pins extending from opposing sides of bowstring release 86 engage cut-outs 100 and 102 for seating bowstring release in a fixed position when bowstring release 86 is retracted into upper housing 82. Because bowstring release 86 is retracted into the same fixed, drawn position in upper housing 82 each time that bowstring 66 is retracted, the power stroke of the crossbow is always the same each time the crossbow is fired.

FIGS. 5-10 generally illustrate the features of upper housing 82. Upper housing 82 is preferably made from machined aluminum. As shown best in FIGS. 5 and 9A, a series of threaded mounting holes extend upwardly into side wall 110 of upper housing 82 for receiving corresponding attachment screws 112, 114 and 116, respectively, used to attach side wall 110 of upper housing 82 to second end 38 of frame member 34. Similar mounting holes are provided in opposing side wall 118.

Figure 6:
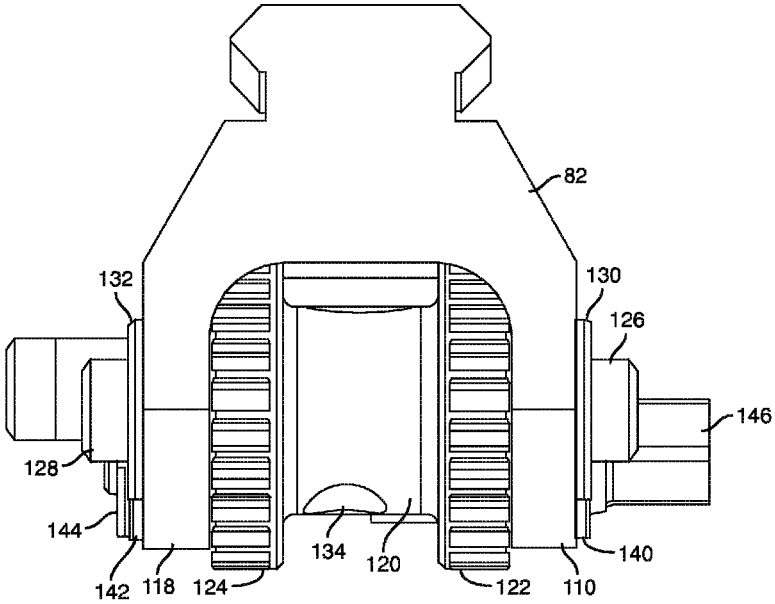
FIG. 6 is a rear view of the upper housing shown in FIG. 5, and illustrating a rope spool rotatably supported therein.
Figure 7:
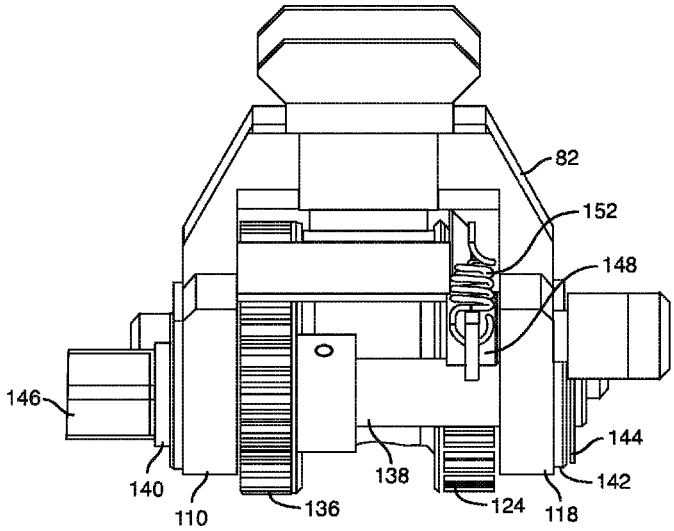
FIG. 7 is a front view of the upper housing shown in FIG. 5, and illustrating a spur gear and drive axle used to rotate the rope spool.
Figure 8:
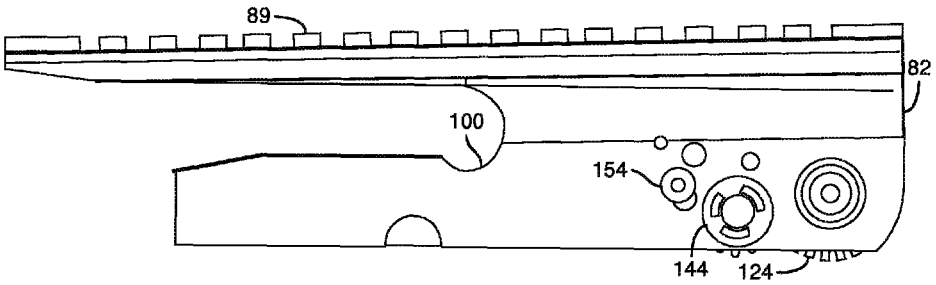
FIG. 8 is a side view of the upper housing shown in FIG. 5.
Figure 10:
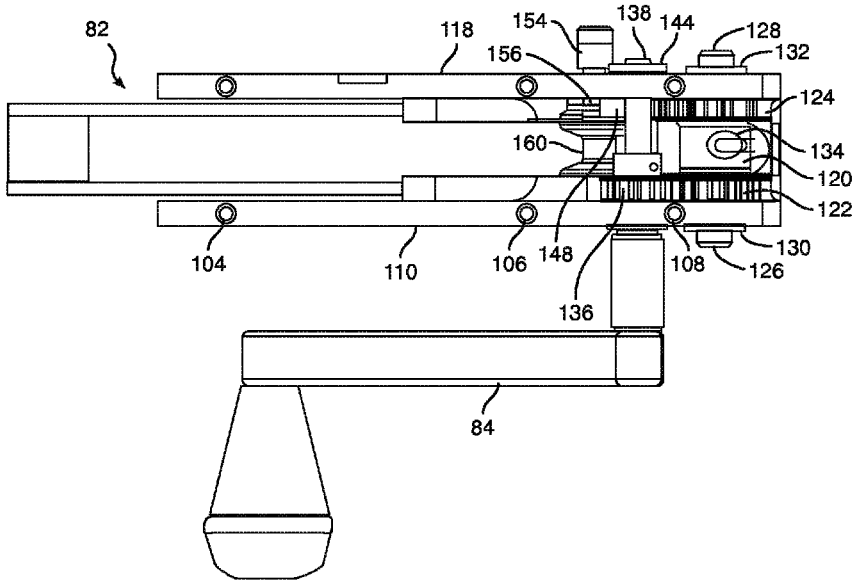
FIG. 10 is a bottom view of the upper housing with the crank arm attached, and the pawl disengaged.

Apart from serving to properly guide bowstring release 86 into its fully-drawn position, upper housing 82 also preferably contains the components used to retract bowstring release 86, and bowstring 66 engaged therewith, away from the riser into the fully-drawn position proximate second end 38 of frame member 34. Referring briefly to FIGS. 6 and 10, a rope spool 120 is formed between a pair of gears 122 and 124. In the preferred embodiment, spool 120 and gears 122 and 124 are integrally machined from hardened tool steel rated at 250 KSI (1,000 psi). Spool 120 and associated gears 122 and 124 are rotatably supported between side walls 110 and 118 of upper housing 82 by a pair of bolts 126 and 128 which extend through holes formed in such side walls into threaded holes formed in the centers of gears 122 and 124. Smooth portions of the shafts of bolts 126 and 128 are supported by bearings 130 and 132, respectively, which bearings are supported within the aforementioned holes formed in the side walls 110 and 118 of upper housing 82. Preferably, spool 120 has a hole 134 formed transversely therethrough for receiving the first end of the retractor rope 88.

In order to rotate spool 120 when retracting rope 88, a spur gear 136 is engaged with spool gear 122. Spur gear 136 is attached to drive axle 138. Drive axle 138 is rotatably supported between side walls 110 and 118 of upper housing 82. Holes are formed in side walls 110 and 118 to accommodate bearings 140 and 142 that rotatably support drive axle 138. A retainer clip 144 is secured over one end of drive axle 138 to retain drive axle 138 within upper housing 82. The opposite end of drive axle 138 includes a square-shaped head 146 for releasably receiving winding crank arm 84. After attaching crank arm 84 over square-shaped head 146, crank arm 84 is rotated to rotate drive axle 138 and spur gear 136, which rotates spool gear 122 and spool 120 to wind rope 88 thereabout. Spur gear 136 includes 14 gear teeth, while spool gears 122 and 124 each include 22 teeth. Accordingly, the force that needs to be applied by a user to crank arm 84 in order to retract bowstring 66 is reduced by the mechanical advantage of the gear ratio 14:22. Crank arm 84 is preferably about five inches in length, compared to the much smaller diameters of gears 136, 122 and 124, and rope spool 120, providing a further mechanical advantage.

Figure 11:
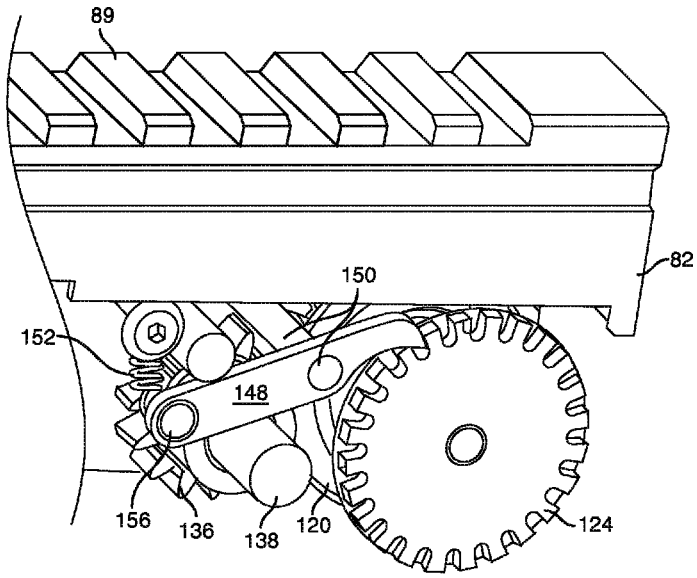
FIG. 11 is an enlarged perspective, sectional view of the gearing and pawl used to wind, and retain, the rope upon the rope spool.

In the absence of any other components, were the user to let go of crank arm 84 after retracting the bowstring, then rope 88 would be pulled back off of spool 120 by the force of the bowstring. To prevent this from happening, a spring-biased pawl 148 is ordinarily engaged with spool gear 124. As shown best in FIG. 11, pawl 148 is mounted for pivotal movement about pin 150 which extends between side walls 110 and 118.

Figure 9A:
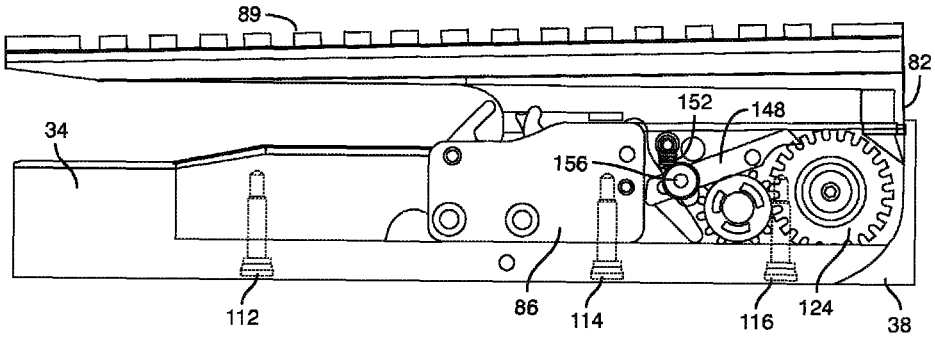
FIG. 9A is a cross-sectional view of the upper housing shown in FIG. 8 wherein a bowstring release has been retracted into the upper housing into its proper drawn position for firing, and wherein a pawl engages one the rope spool gears.
Figure 9B:
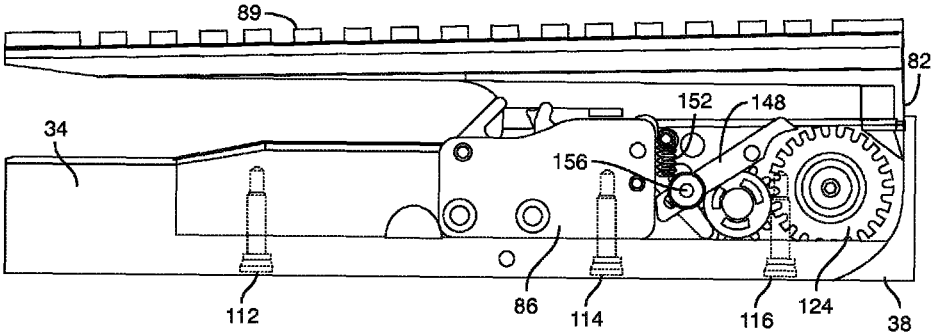
FIG. 9B is a cross-sectional view similar to FIG. 9A but wherein the bowstring release has been retracted into the upper housing beyond its proper drawn position, and wherein the pawl is disengaged from the rope spool gear.
Figure 12:
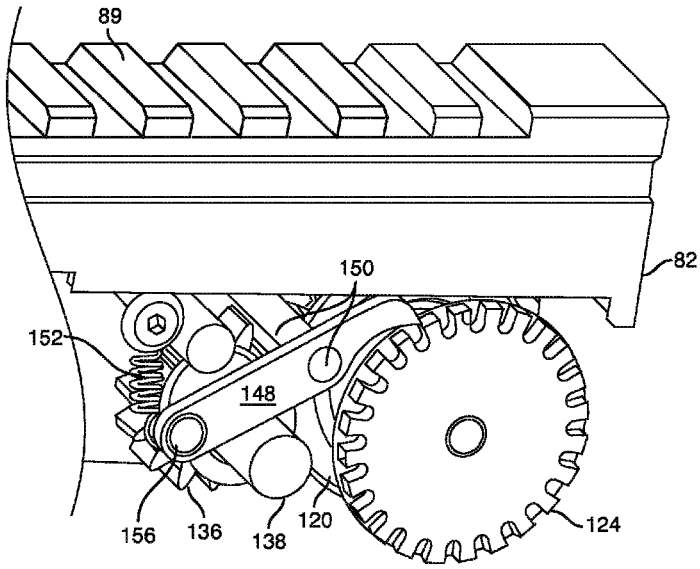
FIG. 12 is a an enlarged view similar to FIG. 11 but with the pawl released for allowing the bowstring release and rope to be withdrawn from the upper housing.

Pawl 148 can pivot between an engaged position (see FIGS. 9A and 11) and a released position (see FIGS. 9B and 12). Biasing spring 152 normally pulls pawl 148 into engagement with spool gear 124; in that case, spool gear 124 may be rotated clockwise (relative to FIGS. 5, 9A, and 11), but not counter-clockwise. The retractor rope winds about the top of spool 120 as crank arm 84 is rotated. If crank arm 84 is released, pawl 148 engages a tooth of spool gear 124, preventing spool 120 from turning in the opposite direction, and preventing rope 88 from unwinding from spool 120.

Referring briefly to FIGS. 9A and 9B, bowstring release 86 is shown received within upper housing 82. In FIG. 9A, bowstring release 86 has been advanced to its proper fully-drawn position, and is ready for firing. In some instances, represented by FIG. 9B, bowstring release 86 may actually be retracted too far into upper housing 82, i.e., beyond to its proper fully-drawn position. However, as shown in FIG. 9B, this causes the rearmost edge of bowstring release 86 to engage the forward-most end of pawl 148, thereby pivoting pawl 148 out of engagement with spool gear 124. As a result, when a user releases crank arm 84, a small amount of rope will unwind from spool 120 until bowstring release 86 no longer engages pawl 148. Spring 152 then forces pawl 148 back into engagement with spool gear 124, thereby ensuring that bowstring release 86 will revert to its proper fully-drawn position.

After firing an arrow from crossbow 20, a user will need to remove bowstring release 86, and retractor rope 88, from upper housing 82 in order to again retract bowstring 66 for the next shot. However, pawl 148 prevents spool 120 from unwinding rope 88 therefrom. Accordingly, a pawl release knob 154 extends from upper housing 82 for allowing the user to forcibly disengage pawl 148 from spool gear 124 to free spool 120. Pawl release knob 154 is attached to a pin 156 that extends through a vertical slot 158 (see FIG. 5) formed in side wall 118 of upper housing 82. Pin 156 is coupled to the forward-most end of pawl 148. When a user pushes pawl release knob downwardly, against the biasing force of spring 152, pin 156 forces the forward-most end of pawl 148 downward, thereby pivoting the rear end of pawl 148 upward, and away from spool gear 124. Thus, if the user pushes down on pawl release knob while withdrawing bowstring release 86 from upper housing 82, the rope retractor assembly will not offer any resistance to such movement.

While not essential, a guide pulley 160 (see FIG. 10), preferably formed of brass, may be rotatably supported within upper housing 82 between side walls 110 and 118 to help guide rope 88 toward spool 120. In addition, those skilled in the art will appreciate that crank arm 84 could, if desired, be used to directly drive rope spool 120 without the aid of a spur gear. While this direct drive approach loses the mechanical advantage provided by spur gear 136, a direct drive system may be suited to crossbows having lesser draw weights. For direct drive, spur gear 136, drive axle 138, and spool gear 122 would be eliminated. The square shaped head 146 would be moved to an extension of a rope spool axle, and crank arm 84 would then be removably connected directly to the rope spool axle. Spool gear 124, and pawl 148 would be retained to prevent rope spool 120 from unwinding rope 88 unintentionally.

Figure 13:
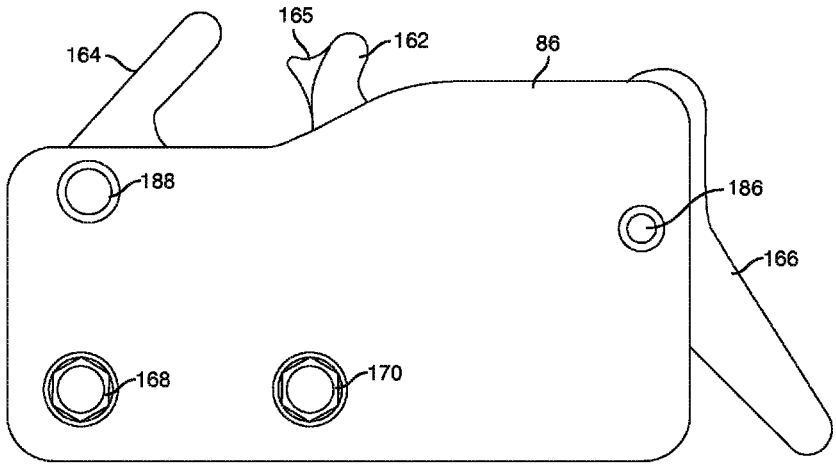
FIG. 13 is a side view of the bowstring release assembly isolated from the other components of the bowstring accessory.
Figure 14:
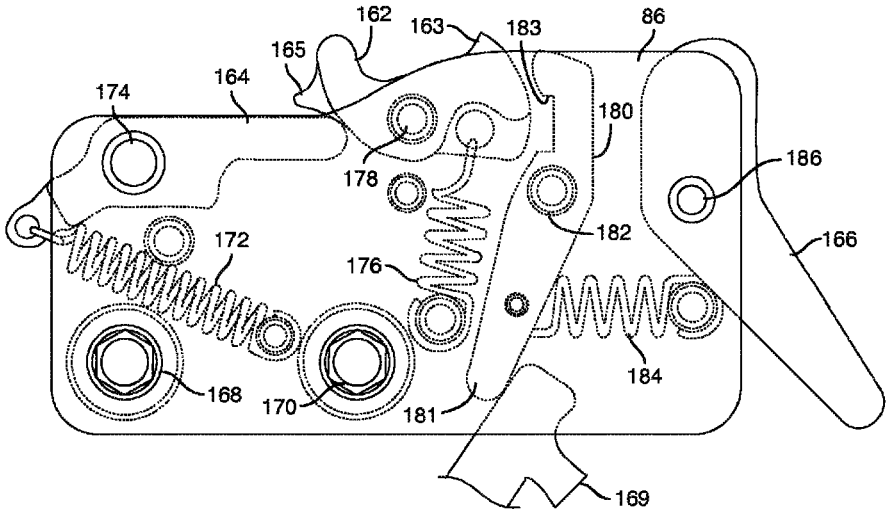
FIG. 14 is a cross-sectional view of the bowstring release assembly shown in FIG. 13, after an arrow is fired.

Turning now to FIGS. 13-18, bowstring release 86 will be described in greater detail. Bowstring release 86 includes a bowstring hook 162, an anti-dry fire (ADF) catch 164, and a cocking lever 166, all of which are pivotally mounted within bowstring release 86. Screws help to secure bowstring release 86 together. As shown in FIG. 14, bias spring tends to pull ADF catch 164 to its upward position, or counter-clockwise about its pivot pin 174 relative to FIG. 14. Bias spring 176 tends to pull bowstring hook 162 upwardly, or clockwise about its pivot pin 178. Sear member 180 does not protrude from bowstring release 86; sear member 180 pivots about pivot pin 182 and is biased in a counter-clockwise direction, relative to FIG. 14, by bias spring 184. Cocking lever 166 (also referred to herein as a "cocking bar") pivots about pivot pin 186 and does not require a biasing spring.

Figure 16:
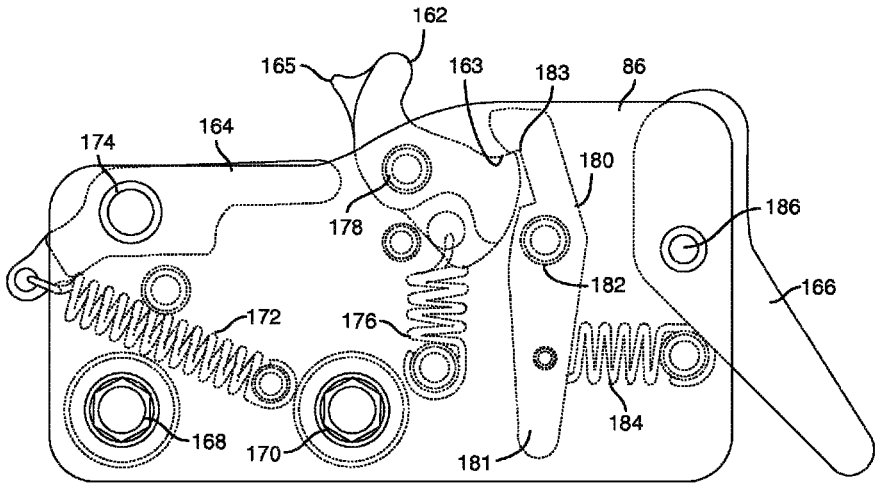
FIG. 16 is a cross-sectional view of the bowstring release assembly shown in FIG. 13, and wherein the bowstring release is armed and ready for firing.

FIG. 16 shows the relationship of the bowstring release components immediately before an arrow is fired. The aforementioned D-loop 67 formed on bowstring 66 (see FIG. 18A) is engaged by bowstring hook 162, and an arrow (not shown in FIG. 16) is nocked with bowstring 66. Bowstring release 86 has been retracted into its drawn position within upper housing 82. ADF catch 164 is depressed to a horizontal configuration, against the force of bias spring 172, by the presence of the arrow nocked with bowstring 66. Bowstring hook 162 includes a sear edge 163 engaged with sear edge 183 on sear member 180. Bias spring 184 is pulling on the lower end 181 of sear member 180 to keep sear edges 163 and 183 engaged. Bias spring 176, which ordinarily pulls bowstring hook 162 clockwise (relative to FIG. 16) is essentially ineffective since bowstring 66 is pulling bowstring hook 162 in a counter-clockwise direction (relative to FIG. 16) with much greater force. Bowstring release 86 is positioned within upper housing 82, and proximate the second end 38 of frame member 34 such that the lower end of sear member 181 lies adjacent to the path of the hammer of lower receiver 22.

FIG. 14 shows the relationship of the bowstring release components immediately after an arrow is fired. When the trigger 26 of lower receiver 22 is pulled, hammer 169 of lower receiver 22 swings forward, striking the lower end of sear member 181 with a force tending to rotate sear member 181 in a clockwise direction relative to FIG. 14. Accordingly, sear edge 183 of sear member 180 is disengaged from sear edge 163 of bowstring hook 162. The force exerted by the D-loop 67 (approximately 170 pounds) rapidly pulls bowstring hook 162 in a counter-clockwise direction, releasing the bowstring 66 from bowstring release 86.

Figure 15:
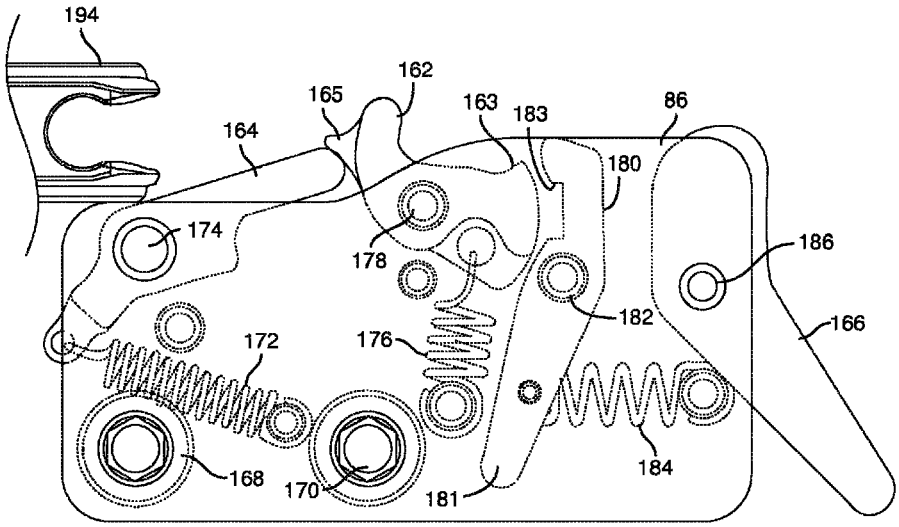
FIG. 15 is a cross-sectional view of the bowstring release assembly shown in FIG. 13, illustrating how the bowstring hook retards an ADF catch from rising prematurely immediately after the bowstring is released.

As noted above, bowstring release includes an anti-dry fire mechanism wherein ADF catch 164 prevents the release of D-loop 67 attached to bowstring 66 if no arrow is properly nocked with bowstring 66 at the time of firing. If a crossbow is fired without an arrow present, the forces generated by the crossbow can result in the bowstring and/or power cables breaking, or in the entire crossbow coming apart, posing a significant danger to the user and others nearby. Referring to FIGS. 13, 15, and 18A, ADF catch 164 is normally pulled upright by bias spring 172. As shown in FIG. 18A, bowstring 66 lies just ahead of ADF catch 164, while D-loop 67 is engaged by bowstring hook 162, behind ADF catch 164. Under normal firing conditions, arrow nock 194 (see FIG. 15) is engaged with bowstring 66, and the presence of arrow nock 194 forces ADF catch 164 downward to a more horizontal position (as per FIG. 16). If trigger 26 of lower receiver 22 is now pulled, and hammer 169 of lower receiver 22 strikes the lower end 181 of sear member 180, sear edges 183 and 163 disengage from each other, and bowstring hook 162 rotates downward. A forwardly projecting nub 165 formed upon bowstring hook 162 temporarily engages the upper end of ADF catch 164, as shown in FIG. 15, to retard the rise of ADF catch 164 until D-loop 67 is entirely free from bowstring hook 162, and until bowstring hook 162 rises back up.

On the other hand, if no arrow is properly nocked in crossbow 20 at the time of firing, then ADF catch 164 remains in its upright position shown in FIGS. 13 and 18A. If the crossbow is inadvertently fired with no arrow present, then bowstring hook 162 will rotate downward to release D-loop 67; however, D-loop 67 will be caught by ADF catch 164, and bowstring 66 will not be released. Remedial action may then be taken to avoid danger to the user, as by re-inserting the crank arm and manually unwinding rope 88 from rope spool 120 while disengaging pawl 148.

Figure 18:
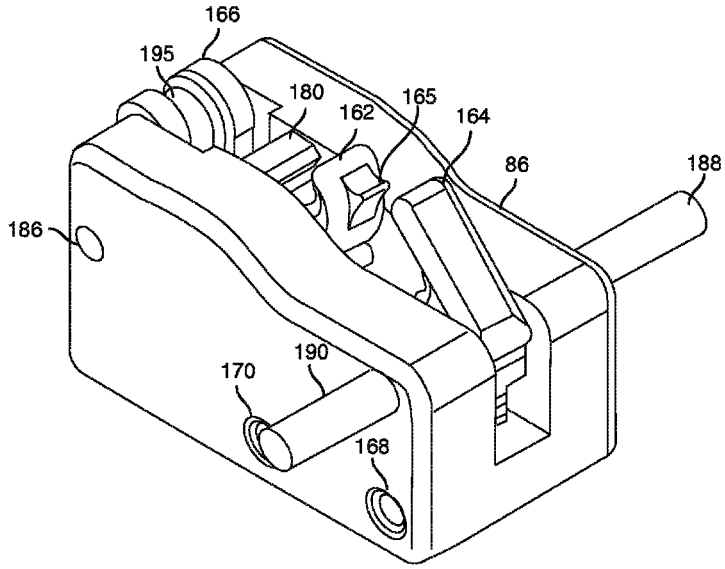
FIG. 18 is a perspective view of the bowstring release shown in FIG. 13.
Figure 18A:
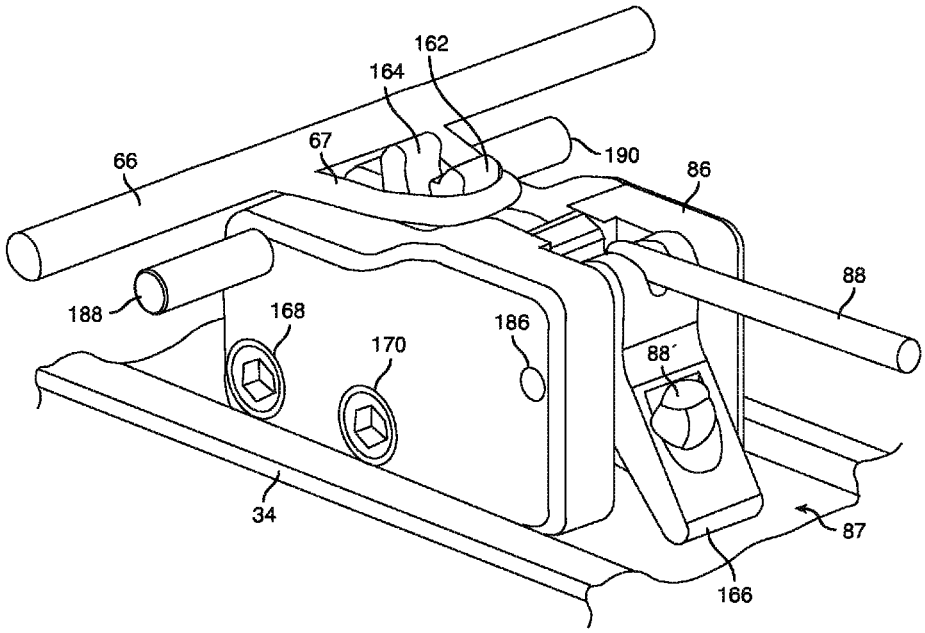
FIG. 18A is a partial perspective view of the bowstring release engaged with a D-loop attached to the bowstring in preparation for retracting the bowstring.

As shown best in FIG. 18, pins 188 and 190 extend from opposing sides of bowstring release 86. If desired, these pins 188 and 190 may actually be integral with pivot pin 174 about which ADF catch 164 pivots. Pins 188 and 190 aid in guiding bowstring release 86 into the proper fully-drawn position within upper housing 82. Pins 188 and 190 enter into cut-outs 100 and 102 (see FIGS. 4 and 5) of upper housing 82 when bowstring release 86 is fully drawn into upper housing 82 to help ensure that bowstring release 86 has been retracted into its fully drawn position.

Figure 17:
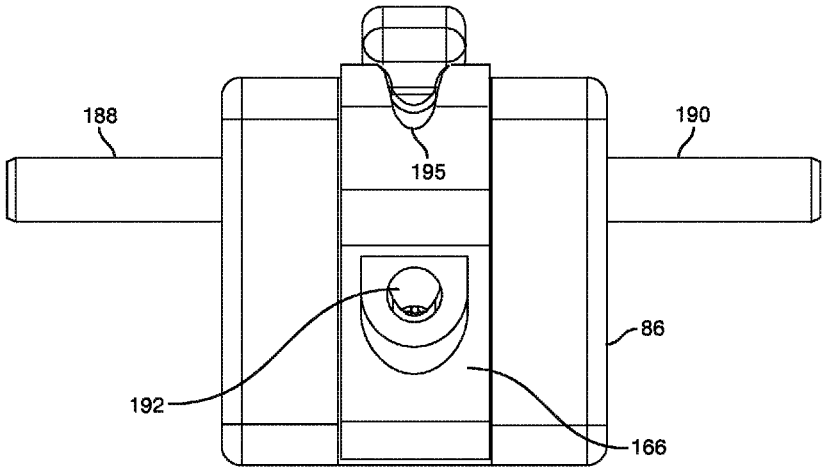
FIG. 17 is a rear view of the bowstring release shown in FIG. 13.

As mentioned earlier, hammer 169 of lower receiver 22 must be cocked before pulling trigger 26. For this reason, bowstring release 86 includes a cocking lever 166 protruding downwardly from the rear end of bowstring release 86. Referring briefly to FIGS. 17 and 18A, cocking lever 166 is designed to engage the free end of retractor rope 88. The free end of retractor rope 88 is passed over the upper end of cocking lever 166 and then through the lower end of cocking lever 166, terminating in an oversized knot 88'. Referring to FIGS. 17 and 18, the upper end of cocking lever 166 has a central channel 195 over which the free end of retractor rope 88 is passed. The free end of rope 88 is then passed down the front side of cocking lever 166 and back out through a hole 192 formed in the lower portion of cocking lever 166 before being formed into an enlarged knot 88'.

When bowstring release 86 is being retracted, rope 88 pulls the upper end of cocking lever 166 backward, forcing the lower end of cocking lever 166 into the configuration shown in FIGS. 13-16. As bowstring release 86 is retracted into upper housing 82, cocking lever 166 catches on the upper end of hammer 169 of lower receiver 22 and forces hammer 169 backward into its cocked position; cocking lever 166 ultimately passes beyond the upper end of hammer 169 as bowstring release 86 is fully retracted.

After the crossbow is fired, and the pawl release knob is operated to release rope spool 120, rope 88 becomes slack, and cocking lever 166 is free to pivot about pivot pin 186. As bowstring release 86 is withdrawn from upper housing 82, cocking lever 166 engages the upper end of hammer 169 of the lower receiver; upon such engagement, cocking lever 166 merely pivots in a counter-clockwise direction (relative to FIGS. 13-16) about pivot pin 186, whereby cocking lever is dragged over the hammer without interfering with the forward movement of bowstring release 86.

Another aspect of the present invention relates to the method of providing crossbow 20 by coupling crossbow accessory 24 to modular lower receiver 22. In practicing such method, the second end of frame member 34 is coupled to lower receiver 22, as by passing pins through attachment holes formed in second end 38 of frame member 34 which mate with attachment holes in the modular lower receiver. Bowstring 66 is retracted toward second end 38 of frame member 34 toward its drawn position, engaged with bowstring hook 162 of bowstring release 86.

The preferred method includes the step of positioning the lower end 181 of sear member 180 of bowstring release 86 proximate to hammer 169 of lower receiver 22 for being contacted by the hammer to release bowstring 66 when trigger 26 of lower receiver 22 is operated.

In the preferred embodiment, the step of retracting bowstring 66 includes the steps of engaging bowstring hook 162 with a D-loop attached to bowstring 66 before retracting bowstring 66. Bowstring release 86 is then retracted toward second end 38 of frame member 34, thereby pulling bowstring 66 away from riser 40 toward its fully-drawn position proximate second end 38 of frame member 34. The step of retracting bowstring 66 preferably includes the step of pulling bowstring release 86 into upper housing 82 proximate lower receiver 22, and positioning the actuating lever (sear member 180) proximate to hammer 169 of lower receiver 22, whereby operation of trigger 26 of lower receiver 22, and resulting rotation of hammer 169, cause bowstring release 86 to release bowstring 66 therefrom.

In practicing the novel method of the present invention, cocking lever 166 engages the upper end of hammer 169 of lower receiver 22, as bowstring release 86 is retracted, to cock the hammer. Preferably, the cocking lever 166 is pivotally secured to bowstring release 86, and one end of retractor rope 88 is secured to cocking lever 166. When the rope 88 is taut (as when bowstring 66 is being retracted), cocking lever 166 is restrained against pivotal movement. Further retraction of bowstring 66 causes cocking lever 166 of bowstring release 86 to engage hammer 169, and to rotate the hammer to its cocked position. On the other hand, after bowstring 66 is released, and rope 88 is allowed to slacken, cocking lever 166 is allowed to pivot around hammer 169 of lower receiver 22 to permit bowstring release 86 to be withdrawn from upper housing 82.

Preferably, the step of retracting bowstring 66 includes the steps of rotatably supporting spool 120 within upper housing 82, winding a first end of rope 88 about spool 120, coupling a second, opposing end of rope 88 to bowstring release 86, and rotating spool 120 to wind rope 88 around spool 120 to pull bowstring release 86, and bowstring 66, toward the drawn position. In the preferred embodiment, the step of winding the first end of rope 88 about spool 120 includes the steps of forming a rope attachment hole 134 extending transversely through spool 120, and passing an end of rope 88 through rope attachment hole 134 for securing rope 88 to spool 120.

In the preferred embodiment of the aforementioned method, a gear 124 is coupled to spool 120, and a pawl is engaged with gear 124 for permitting rotation of spool 120 in a first direction, and for selectively preventing rotation of spool 120 in a second, opposing direction.

In regard to the step of rotating the spool, the preferred form of the novel method includes the steps of coupling a gear 122 to spool 120, rotatably mounting a drive axle 138 in upper housing 82, providing spur gear 136 on drive axle 138, engaging spur gear 136 with spool gear 122, and cranking drive axle 138 to rotate spool 120 for winding rope 88 about spool 120 to retract bowstring release 86 and bowstring 66.

Use of the AR15 lower receiver trigger assembly allows crossbow 20 to fire an arrow with minimal finger pressure (i.e., trigger pull force) notwithstanding significant tension (170 pounds or more) on the bowstring. In this regard, the trigger pull force is entirely independent of the tension on the bowstring. It is only necessary that hammer 169 of the lower receiver apply sufficient force to sear member 180 to activate bowstring release 86. In addition, as explained above, cocking lever 166 on bowstring release 86 automatically cocks hammer 169 of lower receiver 22 as bowstring 66 is retracted.

When purchasing the lower receiver of the AR-15 modular rifle within the United States from one of the many manufacturers of such rifles, a purchaser must obtain a federal gun license. Those sportsman who already own an AR-15 rifle do not require an additional federal license to equip the lower receiver of their rifle with the crossbow accessory of the present invention. In addition, manufacturers of AR-15 rifles, or other weapons that include the lower receiver of an AR-15 rifle, must currently pay an 11% federal excise tax, based upon the wholesale price of the weapon, when such rifles are originally sold to distributors or retailers. On the other hand, the crossbow accessory of the present invention can be sold without payment of the current federal excise tax, as it is can be sold without the lower receiver of the AR-15 rifle to end users who already own a lower receiver of the AR-15 rifle.

The use of bowstring release 86 and flexible retractor rope 88, along with the pawl release and innovative cocking lever, allows a user to fire an arrow, retract the bowstring, and prepare to fire a second arrow, much more quickly than other crossbows. Moreover, the precise positioning of the bowstring release within the upper housing allows highly accurate shots to be consecutively fired, arrow after arrow.

Those skilled in the art will now appreciate that the present invention provides a crossbow having a bowstring release and retraction system which releases the bowstring in an accurate, consistent, and repeatable manner. The construction of the bowstring release avoids the need for excessive trigger pull forces, as the trigger pull force is essentially independent of the draw weight of the crossbow. The described bowstring release and bowstring draw mechanism are relatively lightweight, extremely compact, easy to operate, and are relatively inexpensive. Moreover, the bowstring release incorporates an anti-dry fire catch to safeguard against dry-fire conditions. The disclosed crossbow avoids the need to remove and store a bowstring draw mechanism before firing an arrow, except for removal of the detachable crank arm. In addition, a crossbow constructed as described above does not require the arrow to slide along a top rail, and thereby avoids frictional forces that otherwise result between the arrow and such a top rail. The crossbow described herein allows a user to quickly engage the bowstring with the bowstring release immediately after firing a first arrow, and to quickly retract the bowstring release, and the bowstring, to the fully-drawn position, allowing a second arrow to be fired rapidly after firing a first arrow.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A crossbow comprising in combination:

a. a riser having a central portion and opposing end portions;

b. first and second limbs coupled to the opposing end portions of the riser, the first limb extending from the riser toward a first limb tip, and the second limb extending from the riser toward a second limb tip;

c. a bowstring extending between the first limb tip and the second limb tip for propelling an arrow;

d. an elongated frame member having first and second opposing ends, the first end being coupled to the riser;

e. a trigger disposed proximate the second end of the elongated frame member for being pulled by a user;

f. a bowstring release being movable along the elongated frame member, the bowstring release including a bowstring hook for selectively engaging the bowstring when the bowstring release is moved proximate the riser, the bowstring release including an actuating lever which cooperates with the trigger when the bowstring release is moved proximate the trigger, the actuating lever being responsive to the trigger for selectively releasing the bowstring from the bowstring hook when a user pulls the trigger; and g. a string retractor coupled to the second end of the elongated frame member, and including a rope coupled to the bowstring release for pulling the bowstring release, and the bowstring engaged therewith, away from the riser toward a drawn position proximate the second end of the elongated frame member, wherein the actuating lever of the bowstring release is disposed proximate to the trigger.

2. The crossbow recited by claim 1 wherein the string retractor includes:

a. an upper housing coupled to the second end of the elongated frame member;

b. a spool rotatably supported within the upper housing for winding the rope; and c. means for rotating the spool to wind the rope around the spool to pull the bowstring release, and the bowstring engaged therewith, toward the drawn position.

3. The crossbow recited by claim 2 wherein the spool includes a first gear, and wherein the means for rotating the spool includes:

a. a spur gear engaged with the first gear of the spool;

b. a drive axle coupled to the spur gear; and c. a winding crank for rotating the drive axle;

wherein operation of the winding crank rotates the drive axle and spur gear, which rotates the spool.

4. The crossbow recited by claim 3 wherein the spool includes a second gear, the first and second gears being on opposing sides of the spool, and wherein the means for rotating the spool further includes a pawl engaged with the second gear of the spool for permitting rotation of the spool in a first direction, and for selectively preventing rotation of the spool in a second, opposing direction.

5. The crossbow recited by claim 2 wherein the rope has first and second opposing ends, the first end of the rope being secured to the spool, the second end of the rope being coupled to the bowstring release, and wherein the spool has a hole formed transversely therethrough for receiving the first end of the rope.

6. The crossbow recited by claim 1 wherein:

a. the string retractor includes an upper housing coupled to the second end of the elongated frame member, a spool rotatably supported within the upper housing, and a rope having a first end attached to the spool and a second opposing end coupled to the bowstring release; and b. the string retractor is operative to pull the bowstring release into the upper housing proximate the trigger wherein the actuating lever of the bowstring release is disposed proximate to the trigger.

7. The crossbow recited by claim 6 wherein the elongated frame member includes a channel formed therein extending from at least the bowstring to the upper housing for receiving the bowstring release, and for guiding the bowstring release upon the elongated frame member as the bowstring release is retracted into the upper housing.

8. The crossbow recited by claim 6 wherein the bowstring release includes a cocking bar for cocking the trigger as the bowstring release is retracted into the upper housing.

9. The crossbow recited by claim 2 wherein the spool includes a gear, and wherein the string retractor further includes a pawl selectively engaged with the gear of the spool for permitting rotation of the spool in a first direction, and for selectively preventing rotation of the spool in a second, opposing direction, the string retractor further including a pawl release member for disengaging the pawl from the gear to permit the bowstring release and second end of the rope to be pulled from the upper housing toward the bowstring to engage the bowstring hook with the bowstring.

10. The crossbow recited by claim 8 wherein the cocking bar is pivotally mounted to the bowstring release, wherein the cocking bar is prevented from pivoting when the rope of the string retractor is being retracted, and wherein the cocking bar is permitted to pivot after the pawl is released, whereby the cocking lever avoids interference with the trigger when the bowstring release is pulled away from the upper housing.

11. The crossbow recited by claim 8 wherein:

a. the rope has first and second opposing ends, the first end of the rope being secured to the spool, the second end of the rope being coupled to the bowstring release;

b. the cocking bar is pivotally mounted to the bowstring release;

c. the second end of the rope engages the cocking bar to prevent the cocking bar from pivoting when the rope is taut, and wherein the cocking bar is permitted to pivot when the rope is slack, whereby the cocking lever cocks the trigger as the bowstring is retracted, while the cocking lever avoids interference with the trigger when the rope is slack and the bowstring release is pulled away from the upper housing.

12. The crossbow recited by claim 1 wherein the string retractor includes:

a. an upper housing coupled to the second end of the elongated frame member;

b. a spool rotatably supported within the upper housing;

c. the rope having first and second opposing ends, the first end of the rope being attached to the spool, and the second end of the rope being coupled to the bowstring release; and d. means for rotating the spool to wind the rope around the spool to pull the bowstring release, and the bowstring engaged thereby, toward the drawn position.

13. The crossbow recited by claim 12 wherein the spool includes a first gear, and wherein the means for rotating the spool includes:

a. a spur gear engaged with the first gear of the spool;

b. a drive axle coupled to the spur gear; and c. a winding crank for rotating the drive axle;

wherein operation of the winding crank rotates the drive axle and spur gear, which rotates the spool.

14. The crossbow recited by claim 13 wherein the spool includes a second gear, the first and second gears being on opposing sides of the spool, and wherein the means for rotating the spool further includes a pawl engaged with the second gear of the spool for permitting rotation of the spool in a first direction, and for selectively preventing rotation of the spool in a second, opposing direction.

15. The crossbow recited by claim 12 wherein the spool has a hole formed transversely therethrough for receiving the first end of the rope.

16. The crossbow recited by claim 12 wherein the elongated frame member includes a channel formed therein extending from at least the bowstring to the upper housing for receiving the bowstring release, and for guiding the bowstring release upon the elongated frame member as the bowstring release is retracted into the upper housing.

17. The crossbow recited by claim 12 wherein the spool includes a gear, and wherein the string retractor further includes a pawl selectively engaged with the gear of the spool for permitting rotation of the spool in a first direction, and for selectively preventing rotation of the spool in a second, opposing direction, the string retractor further including a pawl release member for disengaging the pawl from the gear.

18. The crossbow recited by claim 12 wherein the crossbow includes a hammer operated by the trigger, and wherein the bowstring release includes a cocking bar for cocking the hammer of the crossbow as the bowstring release is retracted into the upper housing.

19. The crossbow recited by claim 18 wherein the cocking bar is pivotally mounted to the bowstring release, wherein the cocking bar is prevented from pivoting when the rope of the string retractor is being retracted, and wherein the cocking bar is permitted to pivot after the pawl is released, whereby the cocking lever avoids interference with the hammer of the modular lower receiver when the bowstring release is pulled away from the upper housing.

20. The crossbow recited by claim 18 wherein the cocking bar is pivotally mounted to the bowstring release, wherein the second end of the rope engages the cocking bar to prevent the cocking bar from pivoting when the rope is taut, and wherein the cocking bar is permitted to pivot when the rope is slack, whereby the cocking lever cocks the hammer as the bowstring is retracted, while the cocking lever avoids interference with the hammer when the rope is slack and the bowstring release is pulled away from the upper housing.

* * * * *